US008733887B2

(12) United States Patent
Inoue

(10) Patent No.: US 8,733,887 B2
(45) Date of Patent: May 27, 2014

(54) DROPLET EJECTING DEVICE

(75) Inventor: Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 358 days.

(21) Appl. No.: 12/559,557

(22) Filed: Sep. 15, 2009

(65) Prior Publication Data

US 2010/0079539 A1 Apr. 1, 2010

(30) Foreign Application Priority Data

Sep. 30, 2008 (JP) ..... 2008-252201

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS 6,726,304 B2 * 4/2004 Fassler et al. ..... 347/28
7,533,957 B2 * 5/2009 Kaneko et al. ..... 347/22
2004/0125189 A1 * 7/2004 Kuki et al. ..... 347/104
2005/0007412 A1 * 1/2005 Nishikawa et al. ..... 347/33
2007/0285461 A1 12/2007 Okada

FOREIGN PATENT DOCUMENTS

JP 59-083664 A 5/1984
JP 2004-195908 A 7/2004
JP 2005-225202 A 8/2005
JP 2007-168293 A 7/2007
JP 2007-331116 12/2007

OTHER PUBLICATIONS

Japanese Office Action dated Jun. 19, 2012, issued in the corresponding to Japanese Patent Application.

* cited by examiner

*Primary Examiner* — Alejandro Valencia
(74) *Attorney, Agent, or Firm* — SOLARIS Intellectual Property Group, PLLC

(57) ABSTRACT

A droplet ejecting device includes: a droplet ejecting head having a nozzle surface at which plural nozzles that eject droplets are formed; an applying member applying a cleaning liquid to the nozzle surface; a wiping member disposed so as to be spaced apart from the applying member, and moving relative to the nozzle surface while contacting the nozzle surface, and wiping-off the cleaning liquid applied to the nozzle surface; and a unit for moving that moves both the droplet ejecting head, and the applying member and the wiping member, relative to one another.

9 Claims, 9 Drawing Sheets

DROPLET EJECTING DEVICE

CROSS-REFERENCE TO RELATED APPLICATION

This application claims priority under 35 USC 119 from Japanese Patent Application No. 2008-252201 filed on Sep. 30, 2008, the disclosure of which is incorporated by reference herein.

BACKGROUND OF THE INVENTION

1. Technical Field

The present invention relates to a droplet ejecting device that forms an image on a recording medium by ejecting droplets toward the recording medium.

2. Related Art

Inkjet recording devices (droplet ejecting devices), that eject ink drops out from nozzles of an inkjet recording head (droplet ejecting head) and record an image on a recording sheet, are conventionally known. In order to keep the state of ejecting ink from the nozzles of the inkjet recording head good, the inkjet recording device is provided with a cleaning mechanism that wipes-off contaminating substances such as remaining ink (ink of increased viscosity), foreign matter (paper dust) and the like adhering to the nozzle surface.

Japanese Patent Application Laid-Open (JP-A) No. 2004-195908, for example, discloses a cleaning mechanism that supplies cleaning liquid to a wiping sheet, pushes the wiping sheet containing the cleaning liquid against the nozzle surface of an inkjet recording head, and wipes-off the contaminating substances of the nozzle surface.

SUMMARY OF THE INVENTION

However, in the technique disclosed in JP-A No. 2004-195908, because the applying and the wiping-off of the cleaning liquid are carried out simultaneously, it is difficult to cause the interface separating function of the cleaning liquid to be exhibited.

In view of the aforementioned, the present invention provides a droplet ejecting device that, at the time of cleaning a nozzle surface, can cause the interface separating function of a cleaning liquid to be exhibited.

A droplet ejecting device of a first aspect of the present invention includes: a droplet ejecting head having a nozzle surface at which plural nozzles that eject droplets are formed; an applying member applying a cleaning liquid to the nozzle surface; a wiping member disposed so as to be spaced apart from the applying member, and moving relative to the nozzle surface while contacting the nozzle surface, and wiping-off the cleaning liquid applied to the nozzle surface; and a unit for moving that moves both, the droplet ejecting head, and the applying member and the wiping member, relative to one another.

In the droplet ejecting device of the first aspect, the droplet ejecting head is moved relative to the applying member and the wiping member by the unit for movement. The applying member and the wiping member are disposed so as to be apart from one another. Accordingly, at the time of cleaning the nozzle surface, the cleaning liquid is applied to the nozzle surface by the applying member, and thereafter, the cleaning liquid can be wiped-off from the nozzle surface by the wiping member. By carrying out applying and wiping of the cleaning liquid separately in this way, as compared with a case in which the applying and wiping of the cleaning liquid are carried out simultaneously, the cleaning liquid can be made to stay adhered to the nozzle surface for a long time, and the interface separating function of the cleaning liquid can be exhibited.

In a droplet ejecting device of a second aspect, the applying member applies the cleaning liquid without contacting the nozzle surface.

By applying the cleaning liquid without contacting the nozzle surface in this way, damage to the nozzle surface can be prevented.

In a droplet ejecting device of a third aspect, the applying member is structured to include an applying roller having a rotating shaft that is disposed in a direction orthogonal to a direction of relative movement of the droplet ejecting head.

By using an applying roller of such a structure, the cleaning liquid can be applied to the nozzle surface either by contact or without contact.

In a droplet ejecting device of a fifth aspect, at a time of application of the cleaning liquid, the applying roller rotates in a forward direction with respect to the direction of relative movement of the droplet ejecting head.

By making the rotating direction of the applying roller be the forward direction with respect to the direction of relative movement of the droplet ejecting head in this way, there is little friction with the nozzle surface, and damage to the nozzle surface can be prevented. Further, by making the rotating direction of the applying roller be the forward direction with respect to the direction of relative movement of the droplet ejecting head as described above, as compared with a case in which the applying roller is rotated in the reverse direction, there is little effect of the flow of the cleaning liquid on the meniscuses of the nozzles. Accordingly, the cleaning liquid can be applied to the nozzle surface without destroying the meniscuses, and poor ejecting due to the application of the cleaning liquid can be suppressed.

A droplet ejecting device of a seventh aspect further includes a waste liquid tray disposed at a position facing the nozzle surface, wherein the applying member is disposed at a side nearer to the waste liquid tray than to the wiping member.

Because the cleaning liquid may drip down from the nozzle surface to which the cleaning liquid has been applied by the applying member, it is not preferable for the nozzle surface to be located at the image forming position after application of the cleaning liquid by the applying member and before the wiping-off thereof. Thus, it is preferable to dispose the applying member at the side near to the waste liquid tray in this way.

In a droplet ejecting device of an eighth aspect, the unit for moving relatively moves the droplet ejecting head from an applying member side toward a wiping member side, and application of the cleaning liquid by the applying member and wiping of the cleaning liquid by the wiping member are carried out by movement in one direction.

Due to such a structure, the applying and the wiping of the cleaning liquid can be carried out efficiently by movement of the recording head in one direction.

A droplet ejecting device of a ninth aspect further includes a unit for separating that moves the wiping member in a direction of moving away from the droplet ejecting head.

By providing such a unit for separation, after the cleaning liquid is applied by the applying member, the droplet ejecting head can be made to not contact the wiping member, and the cleaning liquid can adhere to the nozzle surface for a long time.

Because of the above structure, the present invention can cause the interface separating function of a cleaning liquid to be exhibited at the time of cleaning a nozzle surface.

BRIEF DESCRIPTION OF THE DRAWINGS

An exemplary embodiment of the present invention will be described in detail based on the following figures, wherein.

DETAILED DESCRIPTION OF THE INVENTION

An inkjet recording device that is related to an exemplary embodiment of the present invention is described hereinafter.

First, the overall structure of an inkjet recording device 10 will be described.

(Inkjet Recording Device)

Figure 1:
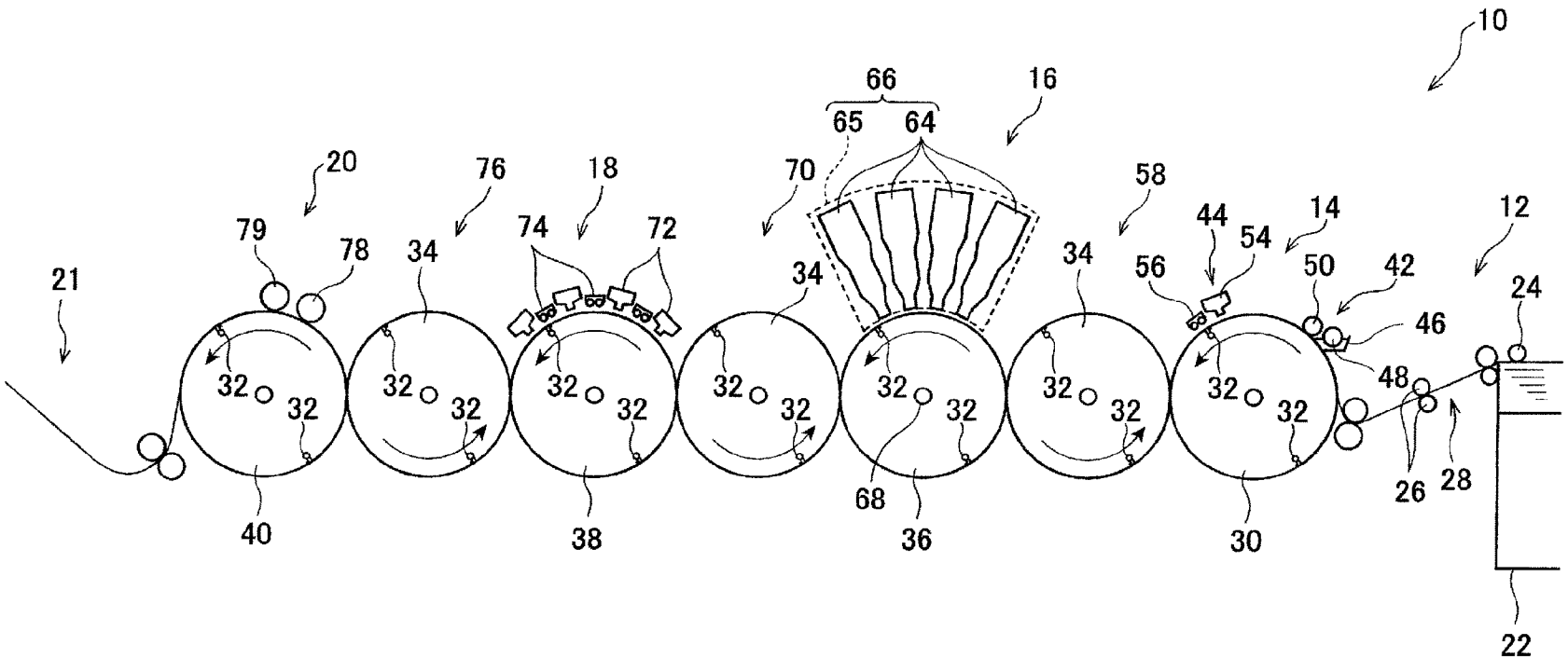
FIG. 1 is an overall structural drawing showing the structure of an inkjet recording device relating to an exemplary embodiment.

As shown in FIG. 1, a feeding/conveying section 12 that feeds and conveys sheets is provided at the image forming device 10 relating to the present exemplary embodiment, at the upstream side in the conveying direction of sheets that serve as recording media. Provided along the sheet conveying direction at the downstream side of the feeding/conveying section 12 are: a processing liquid coating section 14 that coats a processing liquid on a recording surface of the sheet, an image forming section 16 that forms an image on the recording surface of the sheet, an ink drying section 18 that dries the image formed on the recording surface, an image fixing section 20 that fixes the dried image to the sheet, and a discharging section 21 that discharges the sheet on which the image is fixed. Further, a maintenance section 80 (see FIG. 2) is provided adjacent to the image forming section 16.

The respective processing sections will be described hereinafter.

(Feeding/Conveying Section)

A stacking section 22 in which sheets are stacked is provided at the feeding/conveying section 12. A sheet feed portion 24, that feeds one-by-one the sheets that are stacked in the stacking section 22, is provided at the downstream side in the sheet conveying direction of the stacking section 22 (there are cases hereinafter in which "in the sheet conveying direction" is omitted) of the stacking section 22. The sheet that is fed by the sheet feed portion 24 is conveyed to the processing liquid coating section 14 via a conveying portion 28 that is structured by plural roller pairs 26.

(Processing Liquid Coating Section)

A processing liquid coating drum 30 is disposed rotatably in the processing liquid coating section 14. Holding members 32, that nip the leading end portions of sheets and hold the sheets, are provided at the processing liquid coating drum 30. In the state in which a sheet is held at the surface of the processing liquid coating drum 30 via the holding member 32, the sheet is conveyed to the downstream side by the rotation of the processing liquid coating drum 30.

In the same way as at the processing liquid coating drum 30, the holding members 32 are provided as well at intermediate conveying drums 34, an image forming drum 36, an ink drying drum 38 and a fixing drum 40 that will be described later. Further, the transfer of a sheet from an upstream side drum to a downstream side drum is carried out by the holding members 32.

A processing liquid coating device 42 and a processing liquid drying device 44 are disposed along the peripheral direction of the processing liquid coating drum 30 at the upper portion of the processing liquid coating drum 30. Processing liquid is coated onto the recording surface of the sheet by the processing liquid coating device 42, and the processing liquid is dried by the processing liquid drying device 44.

The processing liquid reacts with ink, aggregates the color material (pigment), and has the effect of promoting separation of the color material (pigment) and the solvent. A storing portion 46, in which the processing liquid is stored, is provided at the processing liquid coating device 42, and a portion of a gravure roller 48 is soaked in the processing liquid.

A rubber roller 50 is disposed so as to press-contact the gravure roller 48. The rubber roller 50 contacts the recording surface (obverse) side of the sheet such that the processing liquid is coated thereon. Further, a squeegee (not shown) contacts the gravure roller 48 and controls the processing liquid coating amount that is coated on the recording surface of the sheet.

It is ideal that the film thickness of the processing liquid is sufficiently smaller than the droplet ejected by the head. For example, in a case in which the ejected droplet amount is 2 pl, the average diameter of the droplet ejected by the head is 15.6 μm. If the film thickness of the processing liquid is thick, the ink dot floats within the processing liquid without contacting the recording surface of the sheet. It is preferable to make the film thickness of the processing liquid be less than or equal to 3 μm in order to obtain a landed dot diameter of greater than or equal to 30 μm at an ejected droplet amount of 2 pl.

On the other hand, at the processing liquid drying device 44, a hot air nozzle 54 and an infrared heater 56 (hereinafter called "IR heater 56") are disposed near to the surface of the processing liquid coating drum 30. The solvent such as water or the like within the processing liquid is vaporized by the hot air nozzle 54 and the IR heater 56, and a solid or thin-film processing liquid layer is formed on the recording surface side of the sheet. By making the processing liquid be a thin layer in the processing liquid drying process, the dots of ink that are ejected at the image forming section 16 contact the sheet surface such that the necessary dot diameter is obtained, and the actions of reacting with the thin-layer processing liquid, aggregating the pigment, and fixing to the sheet surface are easily obtained.

The sheet, on whose recording surface the processing liquid has been coated and dried at the processing liquid coating section 14 in this way, is conveyed to an intermediate conveying section 58 that is provided between the processing liquid coating section 14 and the image forming section 16.

(Intermediate Conveying Section)

The intermediate conveying drum 34 is provided rotatably in the intermediate conveying section 58. A sheet is held at the surface of the intermediate conveying drum 34 via the holding member 32 provided at the intermediate conveying drum 34, and the sheet is conveyed to the downstream side by the rotation of the intermediate conveying drum 34.

(Image Forming Section)

The image forming drum 36 (that will be described later) is provided rotatably in the image forming section 16. A sheet is held at the surface of the image forming drum 36 via the holding member 32 provided at the image forming drum 36, and the sheet is conveyed to the downstream side by the rotation of the image forming drum 36.

A head unit 66 is disposed at the upper portion of the image forming drum 36 so as to contact the surface of the image forming drum 36. The head unit 66 is structured so as to include single-pass-type inkjet line heads 64, and a head housing 65 that houses the inkjet line heads 64. At the head unit 66, the inkjet line heads 64 of at least YMCK that are basic colors are arrayed along the peripheral direction of the image forming drum 36, and form images of the respective colors on the processing liquid layer that was formed on the recording surface of the sheet at the processing liquid coating section 14. Image formation is carried out by ejecting ink from nozzles (not shown) of the inkjet line heads 64 on the basis of image data.

The processing liquid has the effect of making the color material (pigment) and the latex particles that are dispersed within the ink aggregate in the processing liquid, and forms aggregates at which flowing of the color material and the like do not arise on the sheet. As an example of the reaction between the ink and the processing liquid, an acid is contained within the processing liquid, and by lowering the pH, pigment dispersion is destroyed, and by using an aggregating mechanism, running of the color material, color mixing between the inks of the respective colors, and ejected droplet interference due to uniting of liquids at the time when the ink drops land are avoided.

The inkjet line heads 64 carry out ejecting of droplets synchronously with an encoder (not illustrated) that is disposed at the image forming drum 36 and detects the rotating speed. Due thereto, the landing positions of the droplets are determined highly accurately, and non-uniform droplet ejection can be reduced independently of deviations of the image forming drum 36, the precision of a rotating shaft 68, or the surface speed of the drum.

Figure 2:
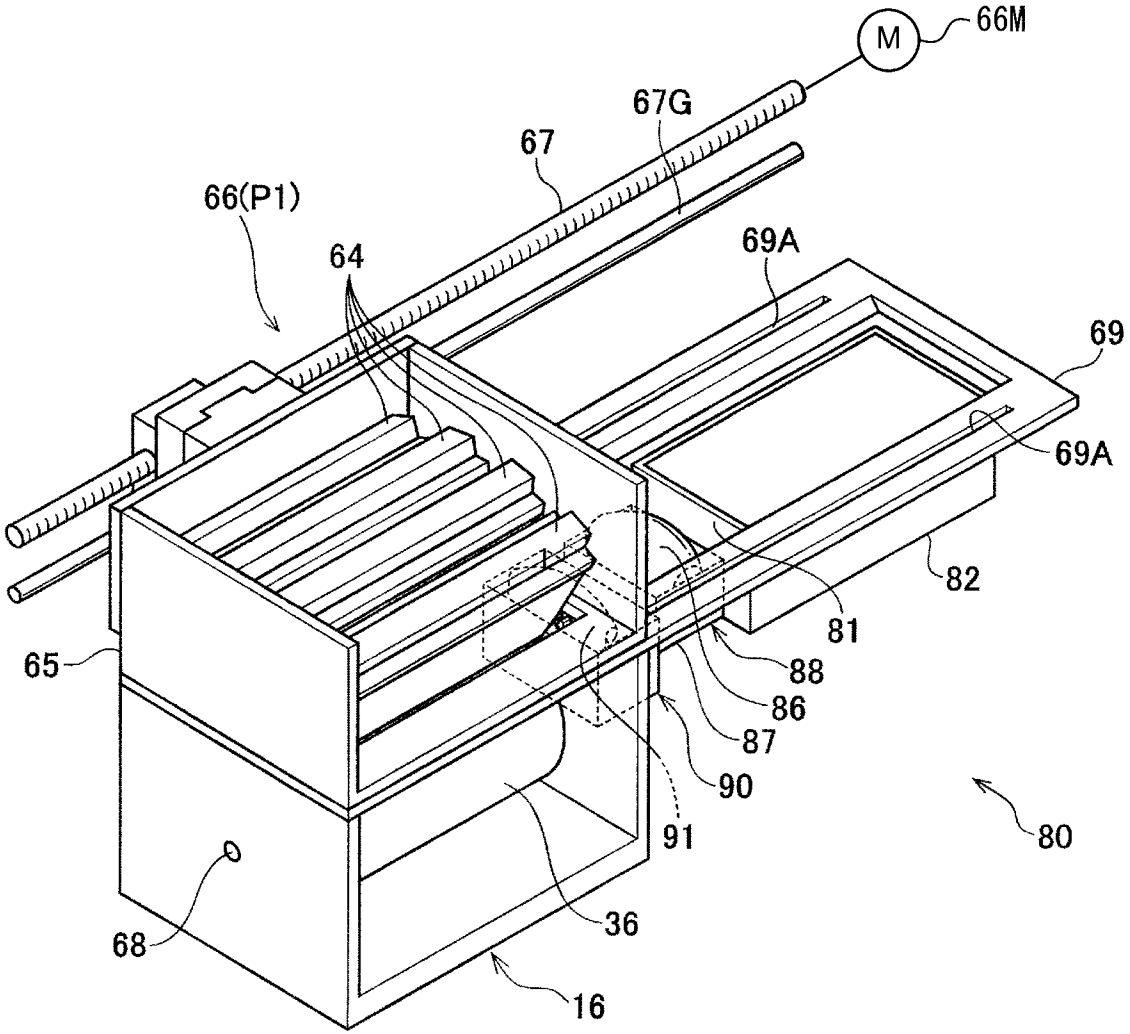
FIG. 2 is a perspective view showing a state in which a head unit is disposed at an image forming section relating to the present exemplary embodiment.

As shown in FIG. 2, the head unit 66 is mounted to a ball screw 67 that is disposed parallel to the rotating shaft 68 of the image forming drum 36. A guide shaft 67G is disposed beneath the ball screw 67, parallel to the ball screw 67. A guide rail 69 is provided beneath the head unit 66. The guide rail 69 is disposed parallel to the ball screw 67. Guide grooves 69A, that are engaged by engaging portions (not shown) that project-out from the bottom surface of the head housing 65, are formed in the guide rail 69. The head unit 66 can move along the guide grooves 69A.

Figure 3:
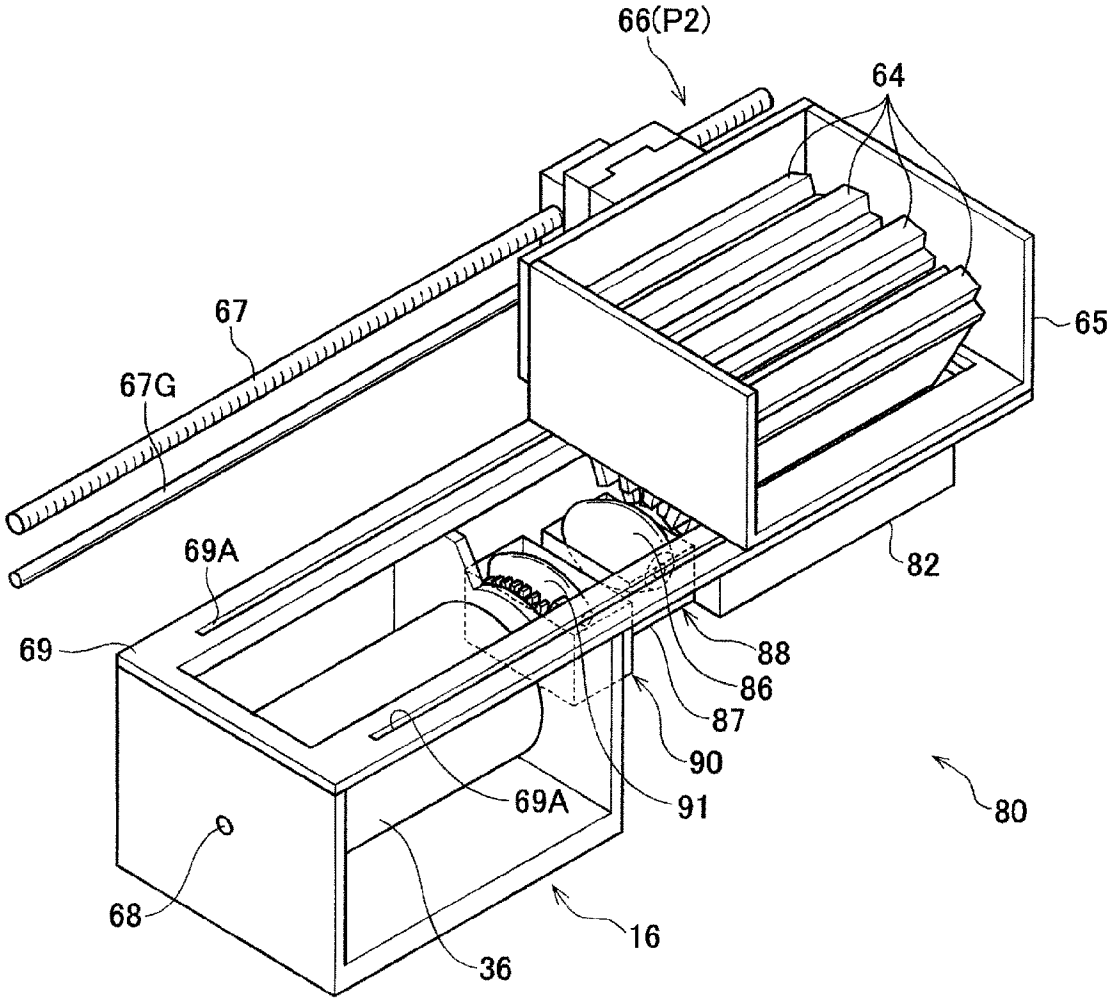
FIG. 3 is a perspective view showing a state in which the head unit is disposed at a maintenance section relating to the present exemplary embodiment.
Figure 4:
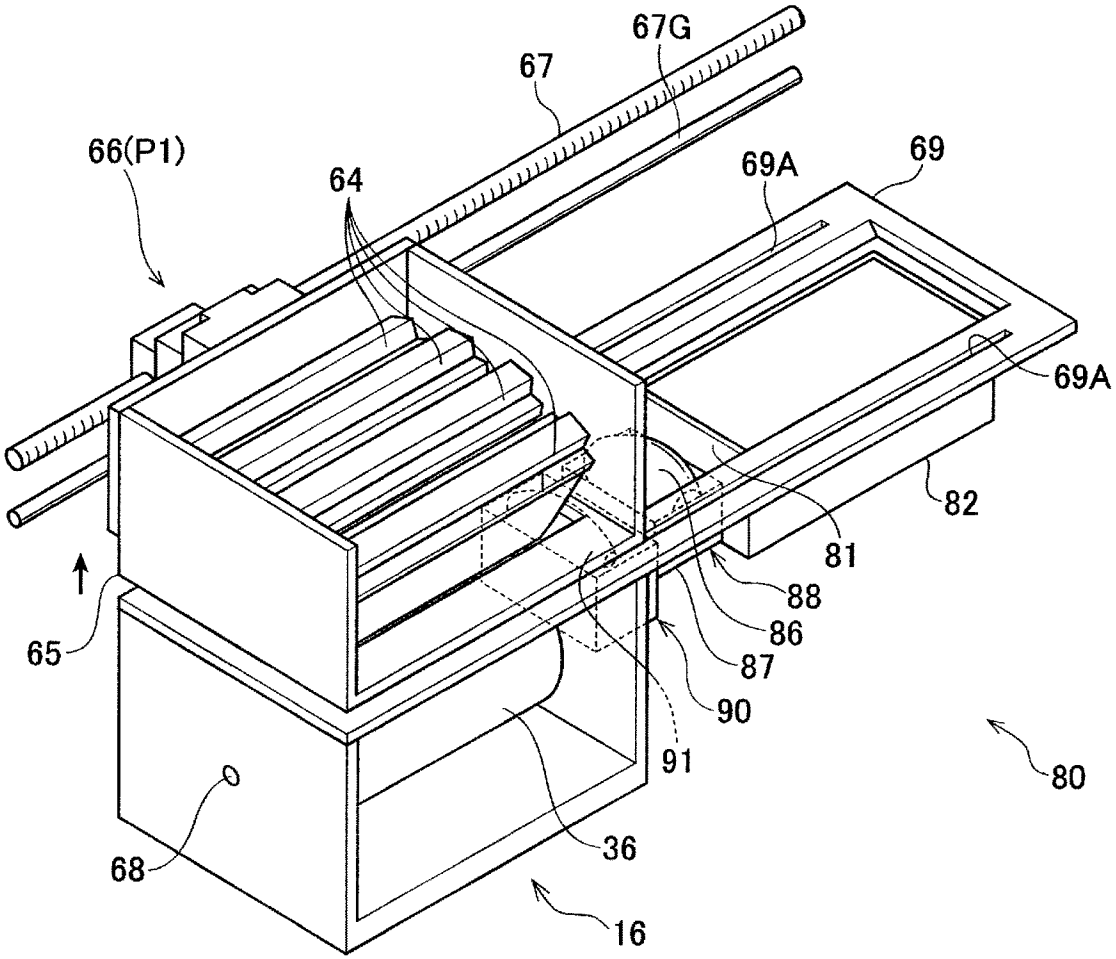
FIG. 4 is a perspective view showing a state in which the head unit is disposed at the image forming section relating to the present exemplary embodiment, and is withdrawn upward.

The ball screw 67, the guide shaft 67G and the guide rail 69 extend from an image forming position P1 above the image forming drum 36, to a maintenance position P2 (see FIG. 3) that is for carrying out maintenance of the inkjet line heads 64. The ball screw 67 is rotated by a driving motor 66M, and due to this rotation, the head unit 66 is moved between the image forming position P1 and the maintenance position P2. Further, as shown in FIG. 4, the head unit 66 can be withdrawn from above the image forming drum 36.

Maintenance operations, such as cleaning the nozzle surfaces 63 of the inkjet line heads 64, expelling ink of increased viscosity, and the like, are carried out at the maintenance section 80 that will be described later.

Due to the rotation of the image forming drum 36, the sheet, on whose recording surface an image is formed, is conveyed to an intermediate conveying section 70 that is provided between the image forming section 16 and the ink drying section 18. However, because the structure of the intermediate conveying section 70 is substantially the same as that of the intermediate conveying section 58, description thereof is omitted.

(Maintenance Section)

Figure 5:
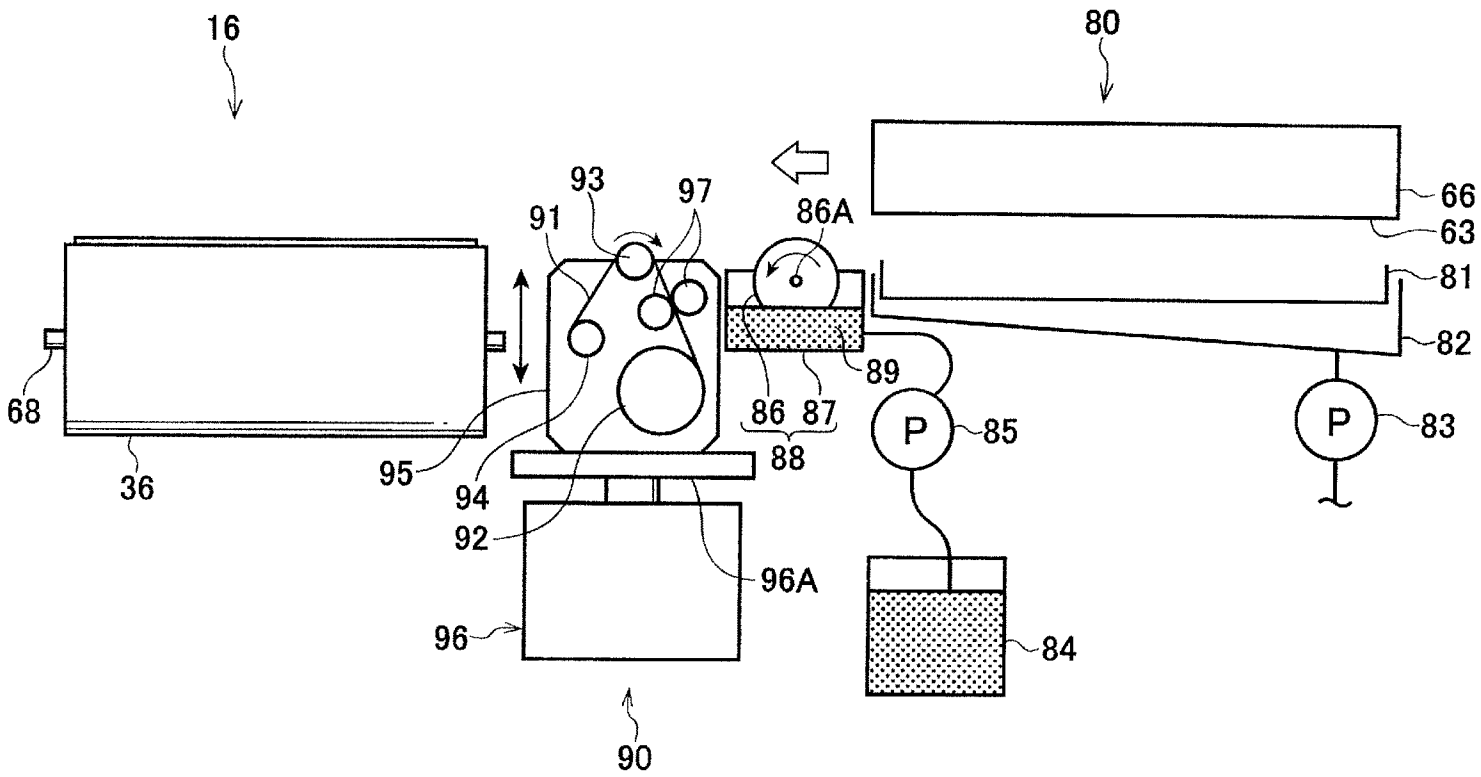
FIG. 5 is a schematic drawing showing the image forming section and the maintenance section relating to the present exemplary embodiment.

As shown in FIG. 2 and FIG. 5, the maintenance section 80 is disposed adjacent to the image forming section 16 along the axial direction of the image forming drum 36. A wiping unit 90, an application unit 88, and a nozzle cap 81 are disposed at the maintenance section 80 so as to be lined-up in that order from the side near the image forming drum 36.

The nozzle cap 81 is a cap for covering the nozzle surfaces 63 of the inkjet line heads 64, and is used at times of making the outer sides of the nozzle surfaces 63 negative pressure so as to suck ink of increased viscosity from the nozzles, and carrying out dummy ejecting that ejects ink out from the nozzles for maintenance rather than printing. A waste liquid tray 82 is provided beneath the nozzle cap 81. A feed-out path 83, for feeding waste liquid out to an unillustrated waste liquid ink tank, is connected to the floor portion of the waste liquid tray 82.

The application unit 88 is structured to include a applying roller 86 and a cleaning liquid tray 87. Cleaning liquid 89 is pooled in the cleaning liquid tray 87. A cleaning liquid containing a solvent such as DEGmBE (diethylene glycol monobutyl ether) or the like can be used as the cleaning liquid 89. Cleaning liquid is supplied to the cleaning liquid tray 87 from a cleaning liquid tank 84 via a supply path 85. While the cleaning operation is being repeated, ink and the like become mixed-in with the cleaning liquid 89 and the concentration thereof changes. Therefore, it is preferable to periodically replace the cleaning liquid 89, or to sense changes in the reflected light (transmitted light) from the cleaning liquid 89 by using a photosensor or the like and replace the cleaning liquid 89, so as to maintain the cleaning ability.

A rotating shaft 86A of the applying roller 86 is disposed in a direction orthogonal to the rotating shaft 68 of the image forming drum 36, and the applying roller 86 can rotate around the rotating shaft 86A. The outer surface of the applying roller 86 is arc-shaped also in the axial direction, so as to run along the nozzle surfaces 63 of the plural (four in the present exemplary embodiment) inkjet line heads 64 that are lined-up. The lower side of the applying roller 86 is immersed in the cleaning liquid 89 that is pooled in the cleaning liquid tray 87. By rotating, the applying roller 86 draws-up the cleaning liquid 89 such that a cleaning liquid film can be formed on the outer surface of the applying roller 86. A rubber roller of silicon, urethane, EPDM or the like, a plastic roller of POM or the like, or a metal roller of SUS or the like can be used as the applying roller 86. In particular, a silicon roller or a POM roller can be suitably used. The direction of rotation of the applying roller 86 is the same direction (the forward direction) as the direction of movement of the head unit 66 at the time of cleaning The application of the cleaning liquid 89 to the nozzle surfaces 63 is carried out by causing the head unit 66 to pass by the upper side of the applying roller 86. At this time, the applying roller 86 does not contact the nozzle surfaces 63 of the inkjet line heads 64. Only the drawn-up cleaning liquid 89 contacts the nozzle surfaces 63, and the cleaning liquid 89 is applied onto the nozzle surfaces 63.

At the wiping unit 90, a wiping sheet 91 is made to contact the nozzle surfaces 63 of the inkjet line heads 64, and wipes-off the cleaning liquid 89 that was applied to the nozzle surfaces 63. The wiping unit 90 is disposed so as to be separated from the application unit 88. A cloth of polyester or polypropylene that has indentations and recesses on the surface thereof can be used as the wiping sheet 91. The wiping unit 90 has a draw-out portion 92, a wiping roller portion 93, a take-up portion 94, a housing 95 and a vertical movement mechanism 96. The wiping sheet 91, that has not yet been used and is in a roll form, is disposed at the draw-out portion 92. The wiping sheet 91 that is drawn-out from the draw-out portion 92 is conveyed by conveying rollers 97, is trained around the wiping roller portion 93, and is taken-up at the take-up portion 94. At the wiping roller portion 93, the wiping sheet 91 is pushed against the nozzle surfaces 63. The drawing-out direction of the wiping sheet 91 is the direction opposite to the direction of movement of the head unit 66 at the time of cleaning The draw-out portion 92, the wiping roller portion 93, and the take-up portion 94 are housed within the housing 95.

The vertical movement mechanism 96 has a moving stand 96A, and the housing 95 is disposed on the moving stand 96A. The moving stand 96A can be moved in the vertical direction by the vertical movement mechanism 96.

(Ink Drying Section)

The ink drying drum 38 is provided rotatably in the ink drying section 18. Plural hot air nozzles 72 and IR heaters 74 are disposed at the upper portion of the ink drying drum 38 so as to contact the surface of the ink drying section 18.

Here, as an example, the hot air nozzles 72 are disposed at the upstream side and the downstream side, and pairs of IR heaters 74 that are lined-up in parallel are disposed alternately with the hot air nozzles 72. Other than this, numerous IR heaters 74 may be disposed at the upstream side and a large amount of thermal energy irradiated and the temperature of the moisture raised at the upstream side, whereas, at the downstream side, numerous hot air nozzles 72 may be disposed and the saturated water vapor blown-away.

Here, the hot air nozzles 72 are disposed such that the angle at which the hot air is blown out is inclined toward the trailing end side of the sheet. Due thereto, the flow of hot air from the hot air nozzles 72 can be collected in one direction. Further, the sheet can be pushed against the ink drying drum 38 side, and the state in which the sheet is held at the surface of the ink drying drum 38 can be maintained.

Due to the warm air from the hot air nozzles 72 and the IR heaters 74, at the portion of the sheet where the image is formed, the solvent that is dispersed by the color material aggregating action is dried, and a thin-film image layer is formed.

The warm air is usually set to 50° C. to 70° C., although it depends on the conveying speed of the sheet. By setting the temperature of the IR heater 74 to 200° C. to 600° C., the ink surface temperature is set so as to become 50° C. to 60° C. The evaporated solvent is discharged to the exterior of the image forming device 10 together with air, but the air is recovered. This air may be cooled by a cooler/radiator or the like, and recovered as liquid.

Due to the rotation of the ink drying drum 38, the sheet, on whose recording surface the image is dried, is conveyed to an intermediate conveying section 76 that is provided between the ink drying section 18 and the image fixing section 20. Note that, because the structure of the intermediate conveying section 76 is substantially the same as that of the intermediate conveying section 58, description thereof is omitted.

(Image Fixing Section)

The image fixing drum 40 is provided rotatably in the image fixing section 20. The image fixing section 20 has the function of applying heat and pressure and fusing the latex particles within the image layer that is a thin layer formed on the ink drying drum 38, and fixing them on the sheet.

A heating roller 78 is disposed at the upper portion of the image fixing drum 40 so as to contact the surface of the image fixing drum 40. At the heating roller 78, a halogen lamp is built-in within a metal pipe of aluminum or the like that has good thermal conductivity, and thermal energy of greater than or equal to the Tg temperature of the latex is provided by the heating roller 78. Due thereto, the latex particles fuse and push-in fixing into the indentations and protrusions on the sheet is carried out, and the unevenness of the surface of the image can be leveled and glossiness can be obtained.

A fixing roller 80 is provided at the downstream side of the heating roller 78. The fixing roller 80 is disposed in a state of press-contacting the surface of the image fixing drum 40, and nipping force is obtained between the fixing roller 80 and the image fixing drum 40. Therefore, at least one of the fixing roller 80 and the image fixing drum 40 has an elastic layer at the surface thereof, and has a uniform nip width with respect to the sheet.

The sheet, on whose recording surface an image is fixed by the above-described processes, is conveyed by the rotation of the image fixing drum 40 toward the discharging section 21 side that is provided at the downstream side of the image fixing section 20.

Note that, although the image fixing section 20 is described in the present exemplary embodiment, it suffices to be able to, at the ink drying section 18, dry and fix the image that is formed on the recording surface. Therefore, the image fixing section 20 is not absolutely necessary.

Next, the cleaning of the nozzle surfaces 63 of the inkjet line heads 64 will be described. Note that the cleaning of the nozzle surfaces 63 may be carried out about the time of the maintenance process that is carried out by the application of pressure (suction), or may be carried out independently.

Figure 6A:
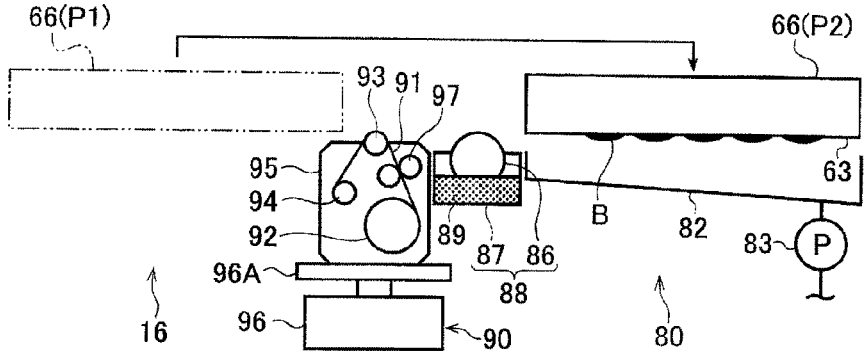
FIG. 6A through FIG. 6D are drawings explaining operations at the time of cleaning a nozzle surface in the present exemplary embodiment.

First, the head unit 66 that is disposed at the image forming position P1 is withdrawn upward so as to not contact the wiping unit 90 and the cleaning liquid of the application unit 88, and is moved to the maintenance position P2 (see FIG. 6A).

Figure 6B:
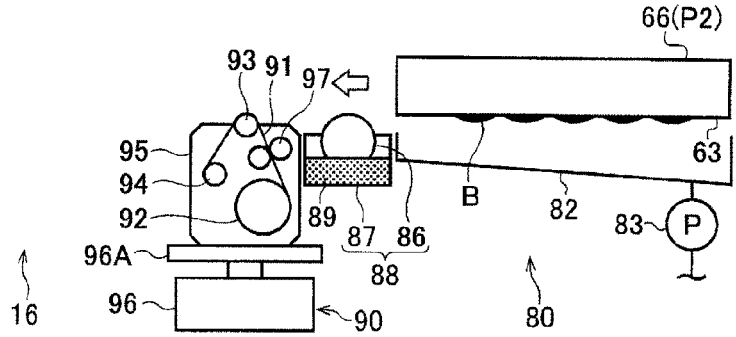

Next, the head unit 66 is lowered such that the nozzle surfaces 63 can contact the wiping unit 90 and the cleaning liquid of the application unit 88, and is moved toward the image forming position P1 (the image forming section 16) (see FIG. 6B). At this time, the applying roller 86, while rotating in the same direction as the direction of movement of the head unit 66, draws-up the cleaning liquid 89 that is pooled in the cleaning liquid tray 87, and forms a cleaning liquid film on the outer surface. Further, the draw-out portion 92 and the take-up portion 94 are driven so that the wiping sheet 91 moves in the direction opposite to the moving direction of the head unit 66.

Figure 6C:
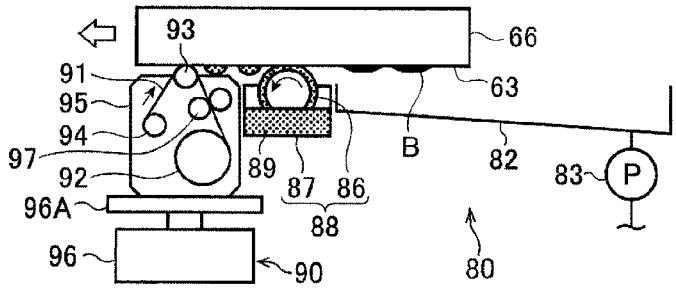
Figure 6D:
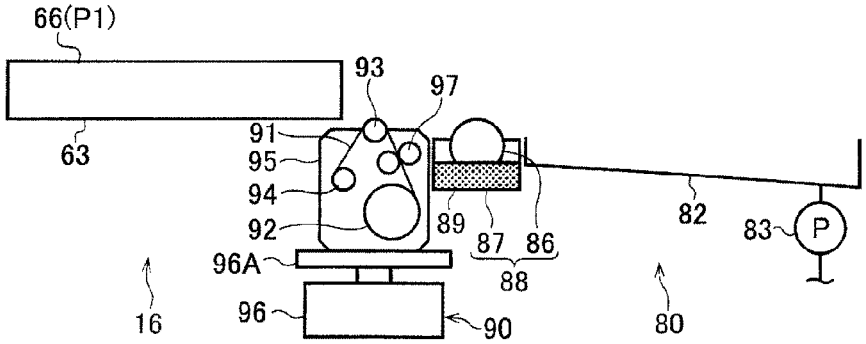

While moving toward the image forming position P1, the nozzle surfaces 63 of the inkjet line heads 64 reach the region above the applying roller 86, and contact the cleaning liquid 89 on the surface of the applying roller 86, and the cleaning liquid 89 is applied thereto. Then, the nozzle surfaces 63 move further in the state in which the cleaning liquid 89 is applied thereto. At this time, adhered matter B that adheres to the nozzle surfaces 63 is dissolved by the cleaning liquid 89. Then, the nozzle surfaces 63 reach the region above the wiping roller portion 93. At this position, the wiping sheet 91 is pressed against the nozzle surfaces 63, and the adhered matter B that is dissolved by the cleaning liquid 89 is wiped-off by the wiping sheet 91 (see FIG. 6C). The application of the cleaning liquid 89 by the applying roller 86 and the wiping-off by the wiping sheet 91 are carried out in succession. The adhered matter B on the entire nozzle surfaces 63 is wiped-off, and the head unit 66 reaches the image forming position P1 (see FIG. 6D).

In the present exemplary embodiment, as described above, the application of and the wiping-off of the cleaning liquid 89 are carried out separately. Accordingly, after separating of the interface between the adhered matter B and the nozzle surfaces 63 is promoted by the cleaning liquid, wiping-off is carried out. Therefore, the adhered matter B can be removed effectively.

Further, in cases in which the nozzle surfaces 63 are greatly dirtied, cleaning can be carried out as follows.

Figure 7A:
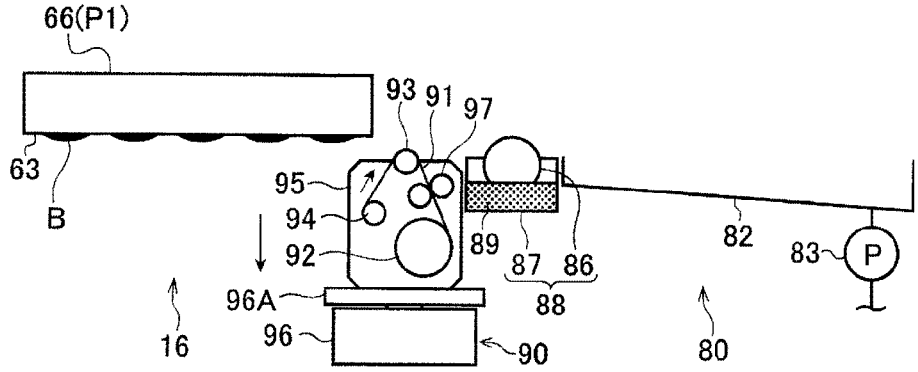
FIG. 7A through FIG. 7D are drawings explaining other operations at the time of cleaning the nozzle surface in the present exemplary embodiment.
Figure 7B:
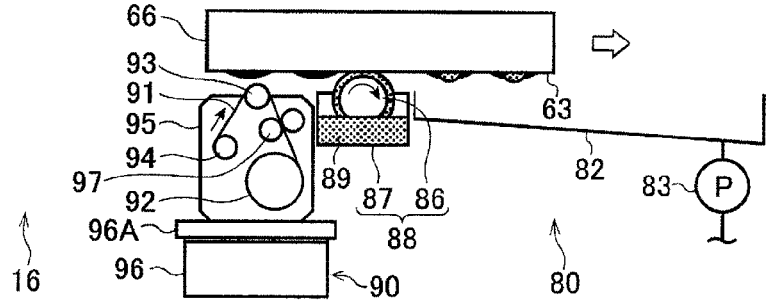
Figure 7C:
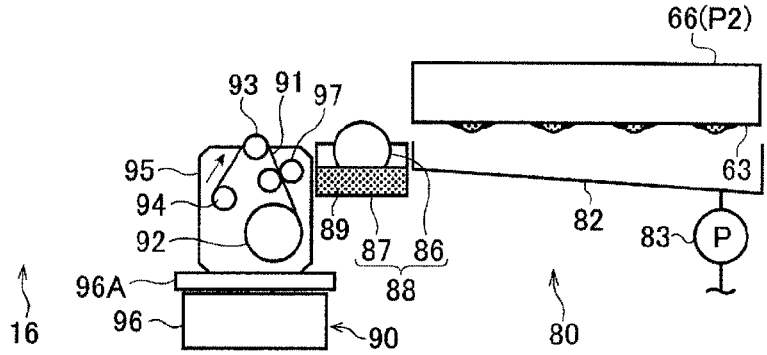

First, the moving stand 96A is lowered by the vertical movement mechanism 96 and the wiping unit 90 is withdrawn downward, so that the wiping sheet 91 does not contact the nozzle surfaces 63 (see FIG. 7A). Then, the head unit 66 is moved from the image forming position P1 toward the maintenance position P2 (see FIG. 7B). While moving toward the maintenance position P2, the nozzle surfaces 63 of the inkjet line heads 64 pass above the wiping unit 90 without contact, and reach the region above the applying roller 86. The applying roller 86 is rotated in the same direction as the direction of movement of the head unit 66, i.e., in the opposite direction of the above-described case of heading toward the image forming position P1. The cleaning liquid 89 on the surface, that has been drawn-up by the applying roller 86, contacts the nozzle surfaces 63, and the cleaning liquid 89 is applied thereto. Then, the head unit 66 moves further and reaches the maintenance position P2 (see FIG. 7C). At this time, the nozzle surfaces 63 have not been wiped and are in a state in which the cleaning liquid 89 is applied thereto. Cleaning liquid may drip downward, but because the head unit 66 is above the waste liquid tray 82, the cleaning liquid can be received in the waste liquid tray 82.

Figure 7D:
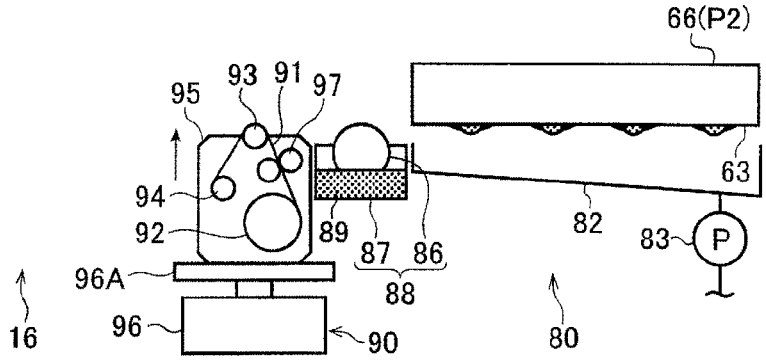

The head unit 66 is made to stand-by at the maintenance position P2 for a predetermined soaking time period. Due thereto, the interface separating effect of the cleaning liquid 89 can be exhibited even more effectively. Thereafter, the wiping unit 90 is returned to the upper side (see FIG. 7D) so that the wiping sheet 91 can contact the nozzle surfaces 63. Then, the head unit 66 is moved toward the image forming position P1. At this time, the applying roller 86 is driven reversely so as to rotate in the same direction as the head unit 66. The cleaning liquid 89 is again applied to the nozzle surfaces 63 at the time when they pass above the application unit 88. The adhered matter B is, together with the cleaning liquid, wiped-off by the wiping sheet 91 of the wiping unit 90 (see FIG. 6A through FIG. 6D).

Note that, although the applying roller 86 does not contact the nozzle surfaces 63 in the present exemplary embodiment, the cleaning liquid may be applied in a state in which the applying roller 86 is made to contact the nozzle surfaces 63. In particular, by applying the cleaning liquid in a non-contact state as in the present exemplary embodiment, the load on the nozzle surfaces 63 can be mitigated.

Further, in the present exemplary embodiment, the direction of rotation of the applying roller 86 is made to be the same direction as the direction of movement of the nozzle surfaces 63, but the rotating direction of the applying roller 86 may be made to be the opposite direction. In particular, by making the rotating direction of the applying roller 86 be the same direction as the moving direction of the nozzle surfaces 63 as in the present exemplary embodiment, the load on the nozzle surfaces 63 can be further suppressed. Further, by making the rotating direction of the applying roller 86 be the forward direction with respect to the relative moving direction of the head unit 66 as described above, as compared with a case in which the applying roller 86 is rotated in the reverse direction, the flow of the cleaning liquid affects the meniscuses of the nozzles less. Accordingly, the cleaning liquid can be applied to the nozzle surfaces 63 without destroying the meniscuses, and poor ejecting due to application of the cleaning liquid can be suppressed.

In the present exemplary embodiment, the application unit 88 is disposed at the side nearer to the maintenance position P2 than the wiping unit 90 is, but such a positional relationship is not absolutely necessary. In particular, by arranging the units in the positional relationship of the present exemplary embodiment, after application of the cleaning liquid, the head unit 66 is disposed at the maintenance position P2. Therefore, when the cleaning liquid that has been applied to the nozzle surfaces 63 drips down, that cleaning liquid can be received by the nozzle cap for maintenance or the like.

Figure 8:
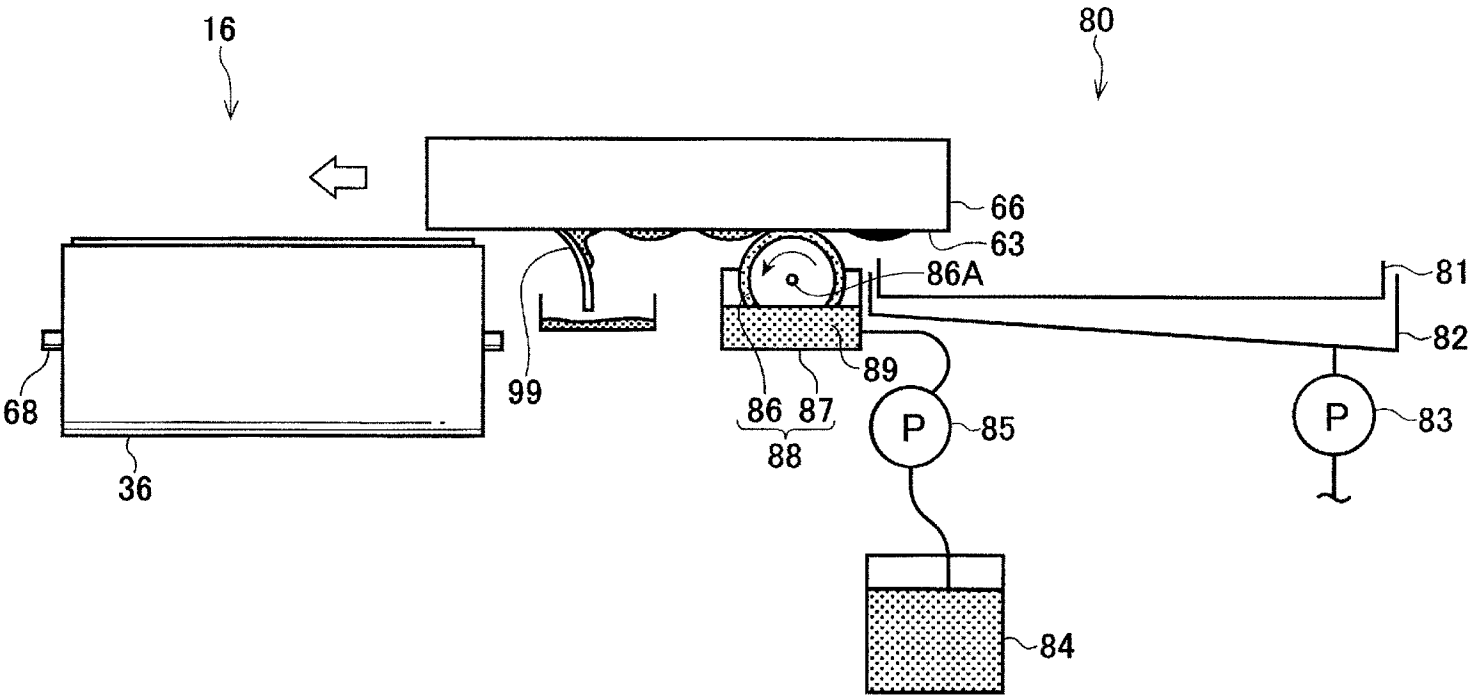
FIG. 8 is a schematic structural drawing showing a modified example of the inkjet recording device relating to the present exemplary embodiment.

Further, the present exemplary embodiment describes an example of carrying out wiping of the nozzle surfaces 63 by the wiping sheet. However, as shown in FIG. 8, wiping can be carried out by moving a blade 99 relatively while causing the blade 99 to contact the nozzle surfaces 63.

Figure 9:
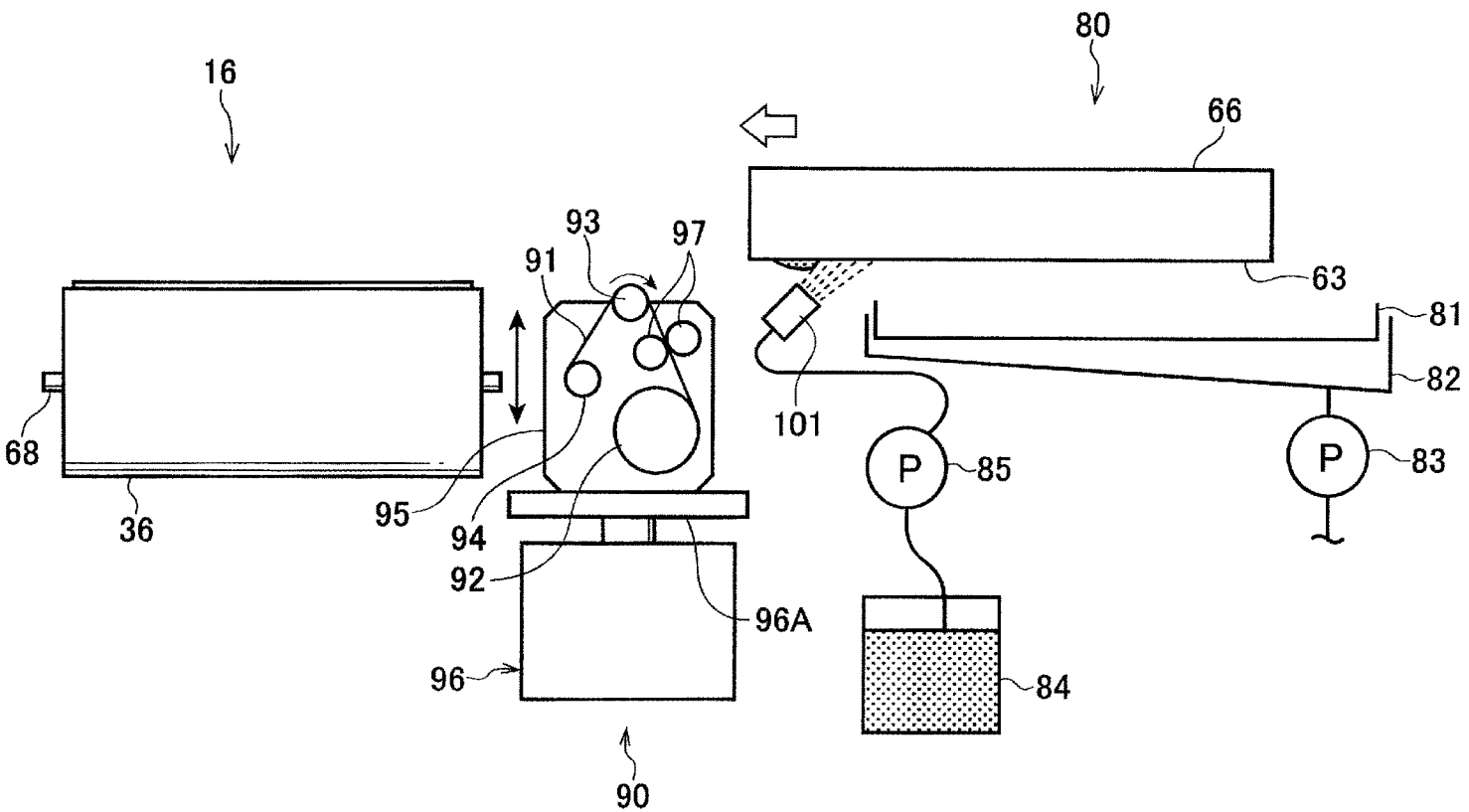
FIG. 9 is a schematic structural drawing showing another modified example of the inkjet recording device relating to the present exemplary embodiment.

Moreover, the present exemplary embodiment describes an example of applying the cleaning liquid by using the applying roller 86, but, as shown in FIG. 9, the cleaning liquid may be blown onto the nozzle surfaces 63 by using a spraying member 101. In this case, it is preferable that the cleaning liquid be blown-out from an oblique direction with respect to the nozzle surfaces 63.

Although the head unit 66 is moved in the present exemplary embodiment, the application unit 88 and the wiping unit 90 may be moved with respect to the head unit 66.

Further, the above exemplary embodiment describes the case of an inkjet recording device that ejects ink and forms an image on a sheet. However, the liquid that is ejected is not limited to ink. For example, the present invention can be applied to drying devices in general of various industrial applications, such as the formation of bumps for parts packaging by ejecting solder in a molten state onto a substrate, the formation of an EL display panel that is carried out by ejecting an organic EL solution onto a substrate, or the like.

EXAMPLE

By using DEGmBE (diethylene glycol monobutyl ether) of a viscosity of 20 CP as the cleaning liquid of the inkjet recording device of the present exemplary embodiment, a cleaning liquid film of 0.5 mm was formed on an applying roller whose diameter was ϕ 40 mm and whose rotational speed was 600 rpm, and the cleaning liquid was applied to the nozzle surfaces with the moving speed of the head unit being 80 mm/sec. A Toraysee (manufactured by Toray Industries, Inc.) was used as the wiping sheet, and was moved at 1.5 mm/sec in the direction opposite the head unit, and wiped-off the nozzle surfaces. The time from the application of the cleaning liquid until the wiping-off of the cleaning liquid by the wiping sheet was approximately 2 seconds. During this time, the cleaning liquid penetrated into the interface between the adhered matter and the nozzle surfaces, interface separation occurred, and the adhered matter was wiped-off well.

What is claimed is:

1. A droplet ejecting device comprising:

a droplet ejecting head having a nozzle surface at which a plurality of nozzles that eject droplets are formed;

an applying member applying a cleaning liquid to the nozzle surface;

a wiping member disposed so as to be spaced apart from the applying member, and moving relative to the nozzle surface while contacting the nozzle surface, and wiping-off the cleaning liquid applied to the nozzle surface;

a unit for moving that moves (i) the droplet ejecting head, and (ii) the applying member and the wiping member, relative to one another; and a waste liquid tray to receive cleaning liquid that falls due to gravity from the nozzle surface after the cleaning liquid is applied to the nozzle surface by the applying member, the waste liquid tray disposed at a position facing the nozzle surface, wherein the applying member is disposed at a side nearer to the waste liquid tray than to the wiping member.

2. The droplet ejecting device of claim 1, wherein the applying member applies the cleaning liquid without contacting the nozzle surface.

3. The droplet ejecting device of claim 1, wherein the applying member is configured to include an applying roller having a rotating shaft that is disposed in a direction orthogonal to a direction of relative movement of the droplet ejecting head.

4. The droplet ejecting device of claim 2, wherein the applying member is configured to include an applying roller having a rotating shaft that is disposed in a direction orthogonal to a direction of relative movement of the droplet ejecting head.

5. The droplet ejecting device of claim 3, wherein, at a time of application of the cleaning liquid, the applying roller rotates in a forward direction with respect to the direction of relative movement of the droplet ejecting head.

6. The droplet ejecting device of claim 4, wherein, at a time of application of the cleaning liquid, the applying roller rotates in a forward direction with respect to the direction of relative movement of the droplet ejecting head.

7. The droplet ejecting device of claim 1, wherein the unit for moving relatively moves the droplet ejecting head from an applying member side toward a wiping member side, and application of the cleaning liquid by the applying member and wiping of the cleaning liquid by the wiping member are carried out by movement in one direction.

8. The droplet ejecting device of claim 1, further comprising a unit for separating that moves the wiping member in a direction of moving away from the droplet ejecting head.

9. The droplet ejecting device of claim 1, wherein the wiping member is configured to selectively refrain, based on an amount of undesired material on the nozzle surface, from wiping-off the cleaning liquid applied to the nozzle surface until after a predetermined soaking time period.

* * * * *